US007363748B2

(12) United States Patent
Gabriele

(10) Patent No.: US 7,363,748 B2
(45) Date of Patent: Apr. 29, 2008

(54) FLUSH MOUNTED LOUVER END CAP WITH TOLERANCE FLASHING

(75) Inventor: Angelo Gabriele, Concord (CA)

(73) Assignee: Vinylbilt Shutter Systems Inc., Concord, ON (CA)

( * ) Notice: Subject to any disclaimer, the term of this patent is extended or adjusted under 35 U.S.C. 154(b) by 290 days.

(21) Appl. No.: 10/956,340

(22) Filed: Oct. 4, 2004

(65) Prior Publication Data

US 2006/0070300 A1 Apr. 6, 2006

(51) Int. Cl.
*E06B 7/08* (2006.01)

(52) U.S. Cl. ..... 49/403; 49/74.1

(58) Field of Classification Search ..... 49/403, 49/82.1, 80.1, 74.1, 90.1, 87.1, 73.1; 52/473; 454/277, 278, 280, 281, 309
See application file for complete search history.

(56) References Cited

U.S. PATENT DOCUMENTS

| | | | | |
|---|---|---|---|---|
| 5,921,028 | A | 7/1999 | Marocco | |
| 6,041,547 | A * | 3/2000 | Marocco | 49/87.1 |
| 6,401,391 | B2 * | 6/2002 | Gabriele | 49/87.1 |
| 6,401,395 | B2 * | 6/2002 | Gabriele | 49/403 |

FOREIGN PATENT DOCUMENTS

| | | |
|---|---|---|
| CA | 2226066 | 6/1999 |
| CA | 2270603 | 9/2000 |
| CA | 2444623 | 4/2005 |

* cited by examiner

*Primary Examiner*—Hugh B. Thompson, II

(57) ABSTRACT

A plastic louver which is to be swingably mounted in a shutter frame has a generally hollow louver body with a mouth at each end of the louver body. An end cap is fitted to each end of the louver body. Each end cap has an insert part which slides into the mouth and a face part which is exposed at the end of the louver body. The face part includes surrounding flashing which locates against without completely covering the mouthwall around the mouth. The flashing is of a size to provide sufficient strength to hold the face part of the end cap from pushing into the mouth of the louver body.

9 Claims, 11 Drawing Sheets

FIG. 6.
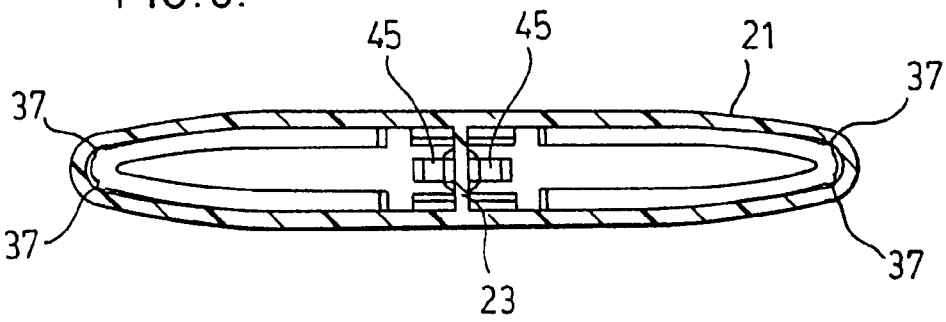
FIG. 7.
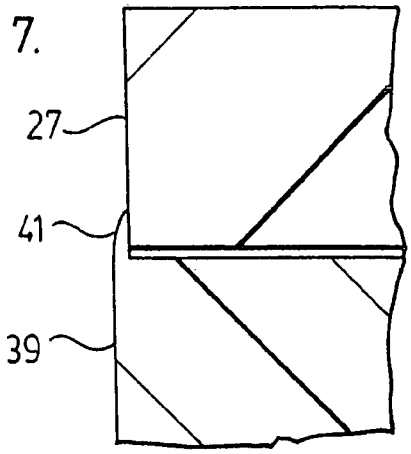
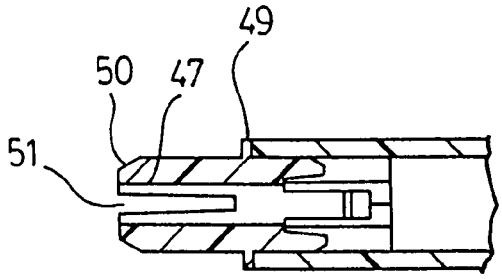
FIG. 8.

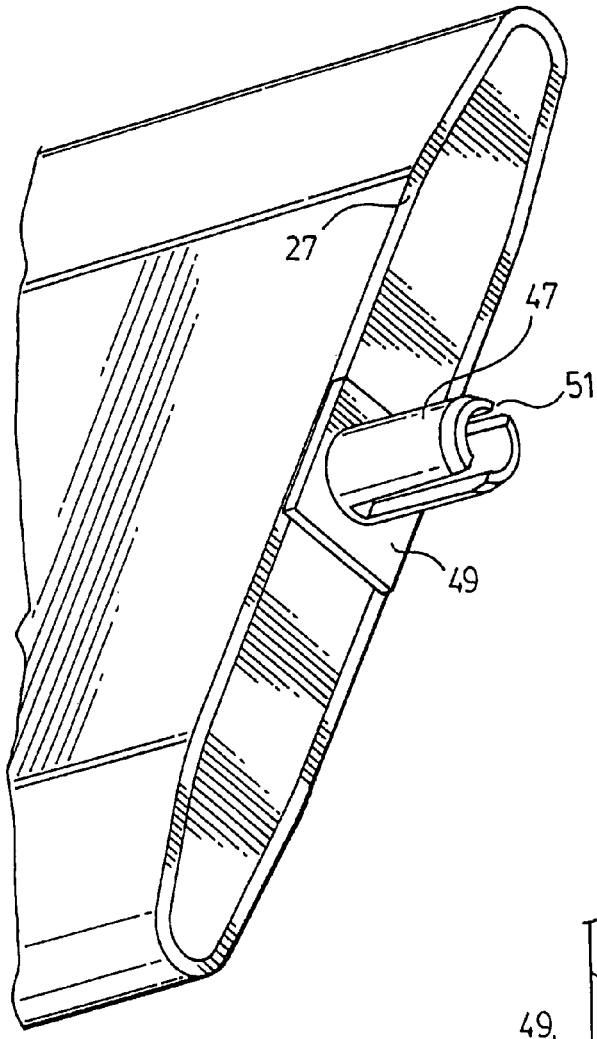
FIG.9.
FIG.10.
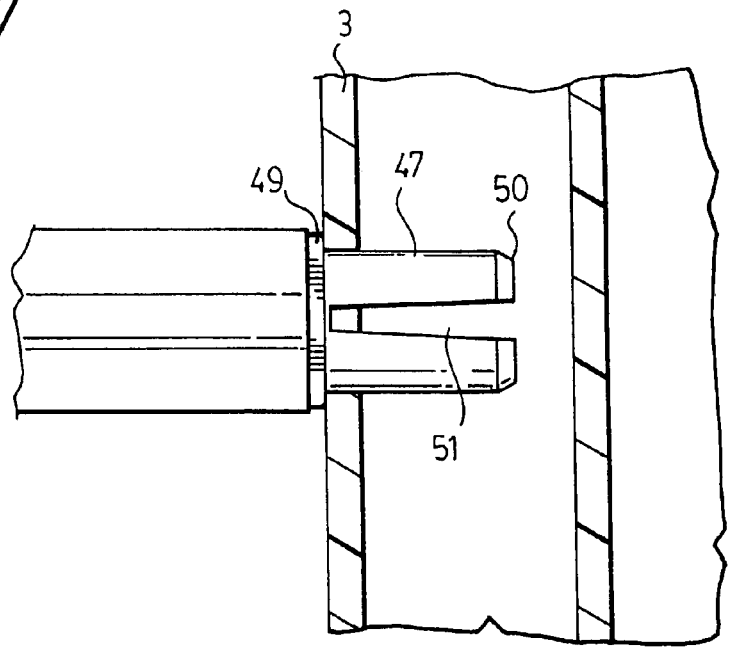

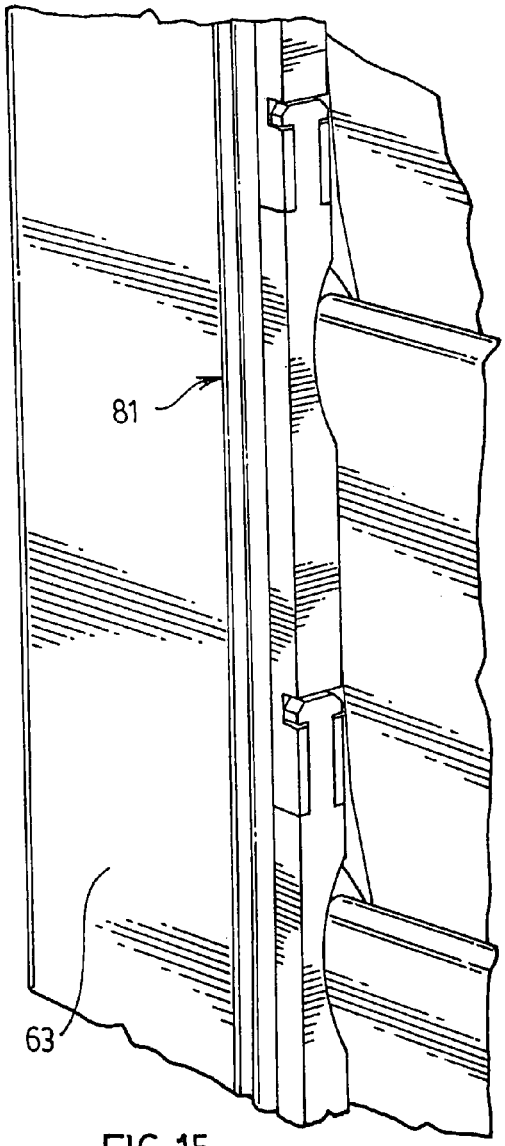
FIG.15.
FIG.16.
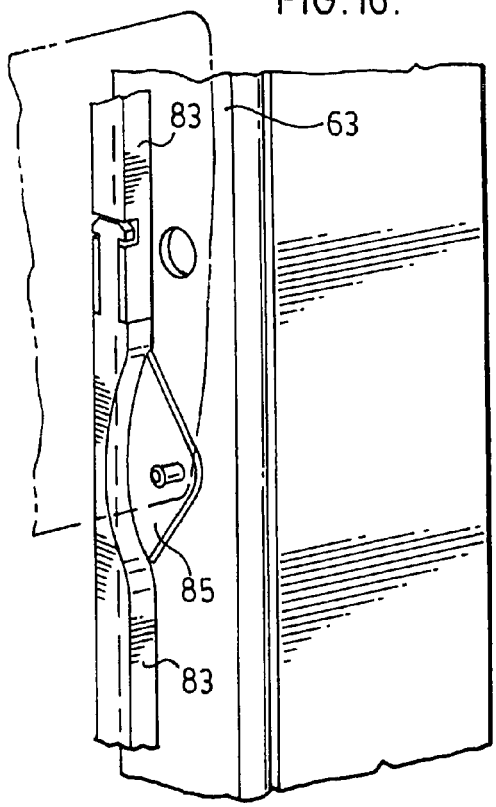

FLUSH MOUNTED LOUVER END CAP WITH TOLERANCE FLASHING

FIELD OF THE INVENTION

The present invention relates to a plastic end cap fittable to a plastic louver usable in an adjustable louver shutter assembly.

BACKGROUND OF THE INVENTION

Dating back some 15 to 20 years ago wooden shutters having movable louvers or slats were very popular in the window covering field. More recently the wooden shutters of the past have been replaced with plastic e.g. vinyl shutters.

A typical vinyl shutter is made with a hollow louver body having an open mouth at each end of the louver body. The open mouth is then fitted with a plastic end cap which includes a central post providing a pivotal mount to be fitted with the shutter frame.

The typical end cap of known plastic shutters has a push in part which inserts into the mouth at the end of the louver body. This end cap further has an external face part which overhangs and completely covers the mouthwall around the mouth at the end of the louver body. This leaves an unsightly gap between the overhang part of the end cap and the end of the louver body. Such a gap is very easily seen from both the inside and outside surfaces of the shutter and clearly distinguishes the typical vinyl shutter from a wooden shutter.

A vinyl shutter is in some respects more desirable than a wooden shutter. For example, a vinyl shutter is typically more durable than a wooden shutter. Furthermore, the fitting of a control bar to a louver is better handled in a plastic shutter than in a wooden shutter. However, most people like the appearance of the more traditional wooden shutter.

The movable louvers in a traditional wooden shutter generally have a solid one-piece construction and therefore do not need to be fitted with end caps. This totally eliminates the unsightly gaps noted above encountered with the fitting of an end cap into a louver of a plastic shutter.

Very recently attempts have been made by a progressive thinking plastic shutter company to make a plastic louver assembly with flush mounted end caps. These flush mounted end caps push into the open mouth at each end of the louver to a position where the external face of the end cap is level with the mouthwall around the mouth of the end cap. In theory, this is a very esthetically appealing answer to making a vinyl louver have the appearance of a wooden louver. However, from a practical standpoint it is very difficult to maintain the flushness of the face of the end cap completely around the mouth of the louver body. This is because the face of the end cap has an outside edge consistent in size with the interior dimensions of the wall around the mouth of the louver body. As such, other than the provision of ribs internally of the louver body there is nothing to preclude the end cap from pushing too far into the louver. When this happens the face of the end cap or at least portions of the face of the end cap sink into the louver body. In some cases, with the known flush mounted end caps they can skew to the point where part of the face of the end cap sinks into the louver body while another part of the face of the end cap protrudes outwardly from the louver body. This becomes particularly unsightly.

SUMMARY OF THE PRESENT INVENTION

The present invention provides a plastic louver to be swingably mounted in a shutter frame. The plastic louver of the present invention comprises a generally hollow louver body having a mouth at each end of the louver body. Each mouth is surrounded by a mouthwall. Further provided is an end cap fitted to each end of the louver body. The end cap comprises an insert part which slides into the mouth and a face part which is exposed at the end of the louver body.

In accordance with the present invention the face part of the end cap includes a surrounding flashing which locates against, without completely covering, the mouthwall around the mouth at the end of the louver. The flashing is of a size to provide sufficient strength to hold the face part of the end cap from pushing into the mouth of the louver body.

The provision of the flashing leaves essentially no sight lines between the end cap and the louver body visible from the front and backsides of the shutter. Furthermore, the flashing holds the face part of the end cap in a level position essentially flush mounted at the end of the louver body.

BRIEF DESCRIPTION OF THE DRAWINGS

The above as well as other advantages and features of the present invention will be described in greater detail according to the preferred embodiments of the present invention in which;

FIG. 6 is a sectional view along the lines 6-6 of FIG. 5;

FIG. 7 is an enlarged sectional view at the edge region of the end cap fitted with the louver body of FIG. 5;

FIG. 8 is a sectional view along the lines 8-8 of FIG. 5;

FIG. 9 is a perspective view of the assembly of FIG. 6;

FIG. 10 shows the frame mount post of the end cap of FIG. 9 as its fits into the frame of the shutter of FIG. 1;

FIG. 15 is an enlarged perspective view of the control bar region of the shutter of FIG. 11 with the louvers in a closed position;

FIG. 16 is a view similar to FIG. 15 taken from the inside of the shutter and showing one of the louvers in phantom lines as connected to the control bar;

DETAILED DESCRIPTION ACCORDING TO THE PREFERRED EMBODIMENTS OF THE PRESENT INVENTION IN WHICH

Figure 1:
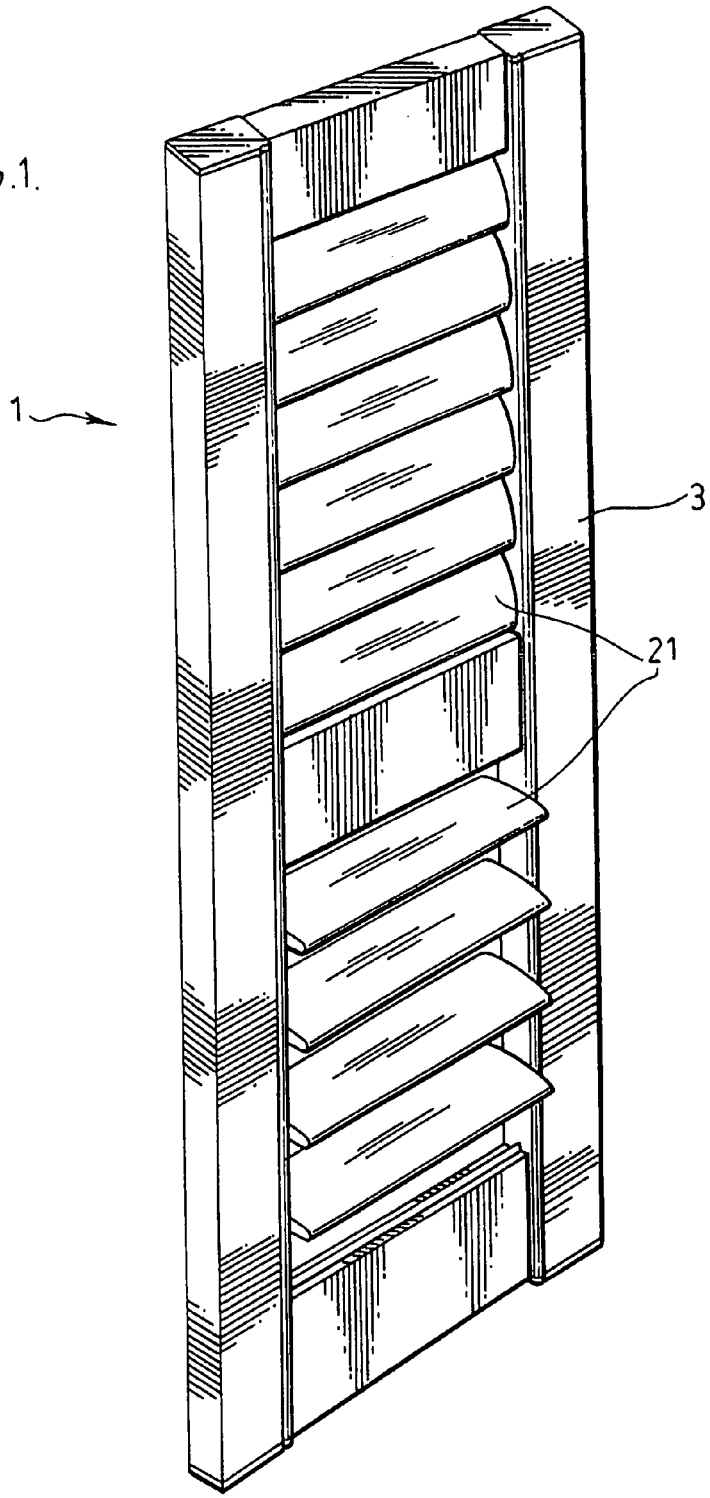
FIG. 1 is a perspective view of a shutter fitted with plastic louvers according to a preferred embodiment of the present invention.

FIG. 1 shows a plastic shutter assembly generally indicated at 1. This shutter assembly which is typically made from a vinyl material comprises a plastic frame 3 with a plurality of plastic louvers 21 pivotally held within frame 3. The louvers can be adjusted relative to the frame to different light blocking and light passing positions as desired. For example in FIG. 1 the louvers in the upper half of the shutter are in a light blocking position. The louvers in the lover half of the shutter are adjusted to a see through light passing position.

Figure 4:
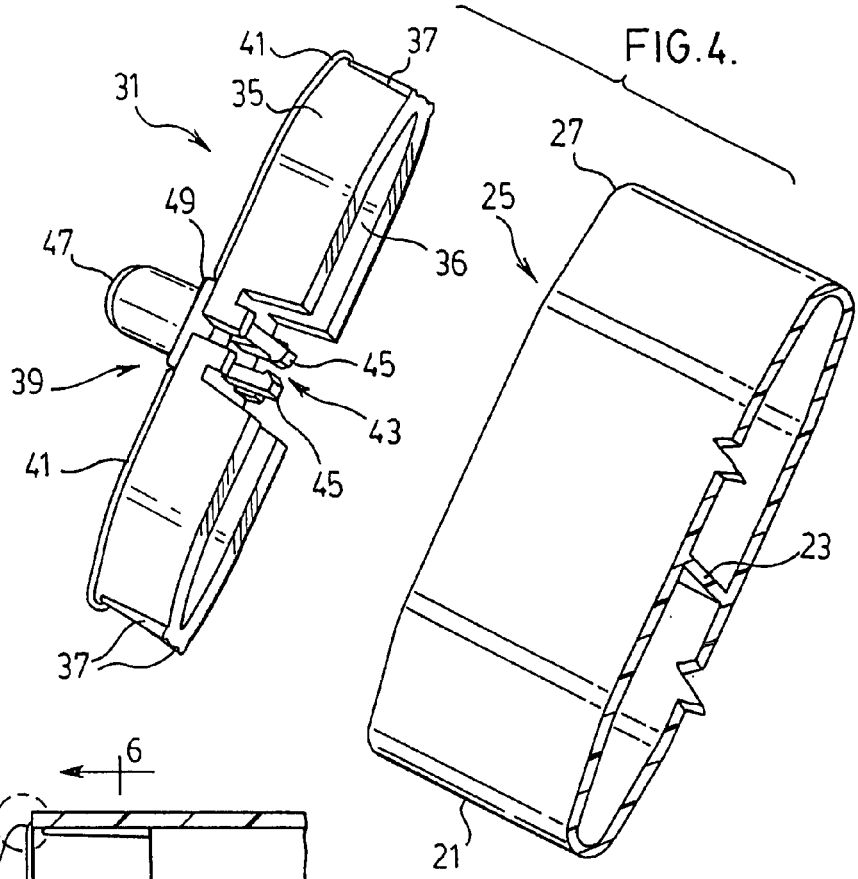
FIG. 4 is an exploded perspective view of an end cap from an end region of one of the louvers from the shutter shown in FIG. 1.

Each of the louvers as shown for example in FIG. 4 of the drawings comprises a generally hollow main louver body with an open mouth 25 to each end of the louver body. The mouth 25 is surrounded by a mouthwall 27 which is the end of the wall forming the louver body. According to this particular embodiment of the invention the louver body is additionally provided with a centrally positioned internal stiffening rib 23.

The louver construction further comprises a plastic end cap 31 which fits with the end of the louver body. A further plastic end cap is provided to the other end of the louver body not known in FIG. 4 of the drawings.

Figure 2:
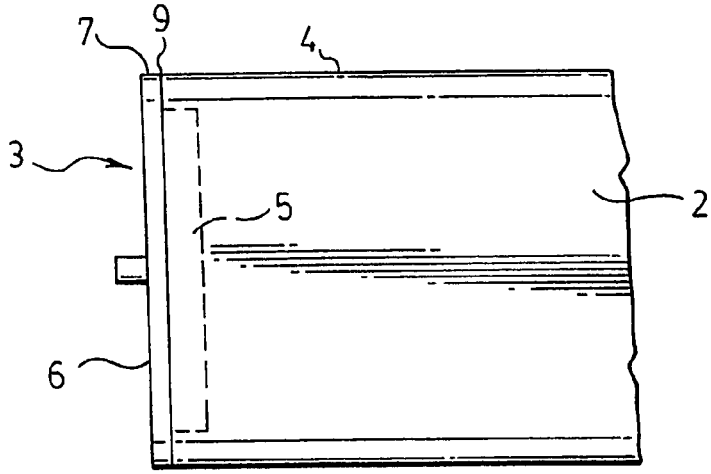
FIG. 2. ( PRIOR ART )
FIGS. 2 and 3 show examples of prior art in the construction of plastic louvers.
Figure 3:
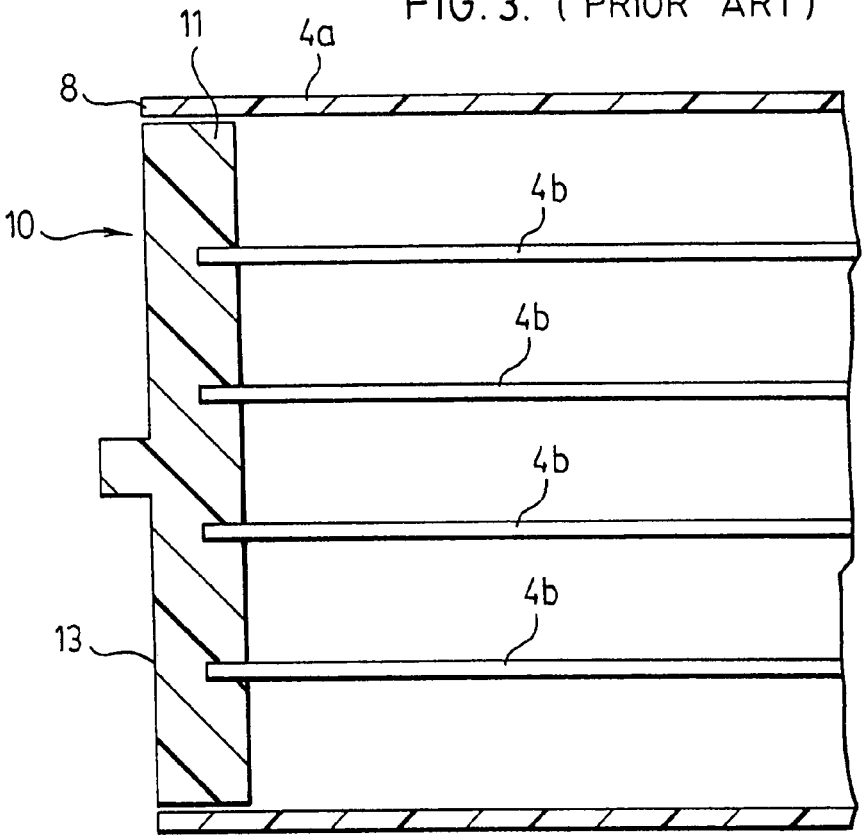
FIG. 3. ( PRIOR ART )

Before going into further description of the assembly of louver body 21 with end cap 31 of FIG. 4 reference is had to FIGS. 2 and 3 of the drawings. These figures show two different prior art constructions of plastic louvers prior to the present invention.

The most typical plastic louver prior art construction is shown in FIG. 2 of the drawings. This construction comprises a generally hollow louver body 4. A plastic end cap generally indicated at 3 is fitted into the open end of louver body 4. This plastic end cap has an insert part 5 which pushes into the louver body and a face part 6 which sits to the outside of the louver body. Face part 6 has an outer edge 7 with an outside dimension that matches the outside dimension of louver body 4. As such, the edge region 7 of the end cap completely covers the wall around the open mouth at the end of the louver body. This leaves a gap producing a sightline 9 around the fully around the louver between the louver body and the end cap. Furthermore, there are generally variances in the width of the gap due to tolerance problems when attempting to produce a flat edge at the end of the louver body. There may also be tolerance problems in the production of a flat faced end cap. As such, sightline 9 may be very noticeable and esthetically unappealing particularly from the relatively long front and backsides of the louver.

When using the construction of FIG. 2 it is very apparent that the louver has a multi-piece plastic construction. This is not desirable when trying achieve the more desirable wooden look of a shutter.

FIG. 3 shows a further prior art louver assembly designed to avoid the sightline problems noted above with respect to the FIG. 2 construction. In FIG. 3, a generally hollow plastic louver body 4*a* is fitted with a plastic end cap 10. End cap 10 has a push in part 11 which slides into the open mouth at the end of the louver body. The end cap further includes an outside face 13 which in the preferred position of FIG. 3 sits flush with the edge of the mouthwall 8 around the mouth of the louver body. In this particular setup the louver body is further provided with internal stiffening ribs 4*b* which locate into appropriate slots cut into the push in part 11 of the end cap.

The prior art setup of FIG. 3 eliminates the gap or sightline 9 of the FIG. 2 setup. However, other problems occur with the assembly of FIG. 3. By way of example in the formation of louver body 4*a* the internal stiffening ribs 4*b* will run the complete length of the louver body. In order to receive the end cap 10 a substantial amount of work is required to cut back the length of each of the stiffening ribs at each end of the louver body. The stiffening ribs or comparable stop means are necessary inside the louver body in order to prevent the end cap from pushing completely into the end of the louver body. Furthermore, the end cap itself can easily rock from the FIG. 3 position such that one end of the end cap tips into the louver body while the other end of the end cap protrudes out from the louver body. This situation which is very visibly apparent from the outside of the louver may easily occur if the louver body does not have sufficient stiffening ribs to properly locate the end cap or if the stiffening ribs themselves are not cut exactly to the same length inside of the louver body. This latter problem can easily occur because the shortening or cutting of the internal stiffening ribs is generally a manual operation.

For all of the above reasons neither of the louver constructions of FIGS. 2 and 3 have provided a satisfactory answer to the making of a plastic end cap which properly fits with a hollow plastic louver.

The description now returns to the present invention and specifically the fitting of end cap 31 to louver body 21 best seen in FIGS. 4 through 8 of the drawings.

End cap 31 is formed by an insert part 35 which slides into the open mouth 25 at the end of louver body 21. Insert part 35 is not solid but rather comprises a wall partially wrapping around a central hollow region 36. The insert part or wall 35 is broken generally centrally of the end cap to form a cut out region generally indicated at 43 produced in the insert part. Provided within this cut out region are a pair of grip arms 45.

Provided towards each end and on each side of insert part 35 are a pair of protruding ribs 37. The purpose of ribs 37 and grip arms 45 will be described later in detail.

End cap 31 further includes a face part 39 which is perpendicular to the insert part 35. Provided as an edging around face part 39 is a flashing 41. This flashing comprises a flashing of the plastic material used in making the end cap. Flashing 41 provides a small ledge or overhang protruding slightly outwardly beyond insert part 35.

Also formed on the end cap is a frame mounting post 47. As best seen in FIG. 8 of the drawings post 47 has a generally cylindrical configuration with a slight taper 50 at its free end. A slot 51 extends lengthwise of post 47.

Post 47 is provided on the face part of the insert at a thickened region 49 which forms the base of the post. Thickened region 49 provides reinforcement for the end cap directly above or to the outside of the cut out region 43 in the insert part 35 of the end cap.

The relative shape and dimensions of the end cap and the louver body are such that the insert part 35 of the end cap can be forced into the open mouth 25 at the end of the louver body. As the end cap is forced into position the grip arms 35 slide to opposite sides over the internal stiffening rib 23 of the louver body. At the same time the ribs 37 engage with the interior surface of the louver body towards each end of the end cap. This in combination with the central weakening of the insert part 35 due to the provision of cut out region 43 produces a slight buckling of the end cap. As a result of this buckling the grip arms 45 are forced to tightly clamp onto stiffening rib 23. It is to be noted in FIG. 4 of the drawings that the grip arms 45 have a cam shaping which allows them to slide along the stiffening rib while the end cap is being pushed into position. However, this same cam shaping of the grips causes them to lock onto the stiffening rib in a direction which makes it very difficult to inadvertently pull the end cap out of the mouth of the louver body. As such, both the ribs 37 and the grip arms 45 cooperate with one another in positively locking the end cap in position on the louver body.

Another key feature found in the fitting of the end cap to the louver body is the function provided by flashing 41. When the end cap is pushed into its fully inserted position flashing 47 seats against the exposed surface of mouthwall 27 around the mouth at the end of the louver body. Flashing 41 is sized such that it is sufficiently strong to act as a stop in preventing the end cap from "over inserting" into the louver body. In order to achieve its stop action flashing 41 should have a minimum extension outwardly from the insert part 35 of about 5 thousandths of an inch. If the extension of the flashing 41 is less than 5 thousands of an inch the flashing will typically not have sufficient strength to prevent the face part of the end cap from being pushed too far into the louver body at at least some locations around the end cap. Furthermore, if the extension of the flashing material is less than 5 thousandths of an inch and if there are tolerance problems between the end cap and the louver body there may not be sufficient flashing material to cover unsightly gaps between the end cap and the louver body around the edge of the end cap.

A preferred extension dimension for the flashing 41 is between 5 and 25 thousandths of an inch. In this range, the flashing will have the strength and stiffness needed to fulfill its stop properties and at the same time the flashing will not completely cover the mouthwall 27 of the louver body. Preferably, the flashing only extends onto the mouthwall sufficiently far to act as an end cap stop. Furthermore, as best seen in FIG. 7 of the drawings the flashing preferably has a tapered shape at the outside surface of the end cap. The inside surface of the flashing is on the other hand flat so that it lies flushly against mouthwall 27. With this particular shaping the flashing comes to a very fine edge on the mouthwall. This has two positive benefits. Firstly, the merging of the flashing with the mouthwall leaves essentially no visible lines between the flashing and the mouthwall. Secondly, the outward thinning of the of the flashing makes it extremely easy to control the tolerance of the flashing such that it will sit tightly against the mouthwall completely around the end cap.

FIG. 8 of the drawings shows that the reinforced face region 49 at the base of post 47 also abuts the mouthwall 27 of the louver body. As such, the thickened region 49 not only strengthens the end cap at the location of the post but in addition provides a further stop against the end cap pushing overly far into the louver body.

Figure 5:
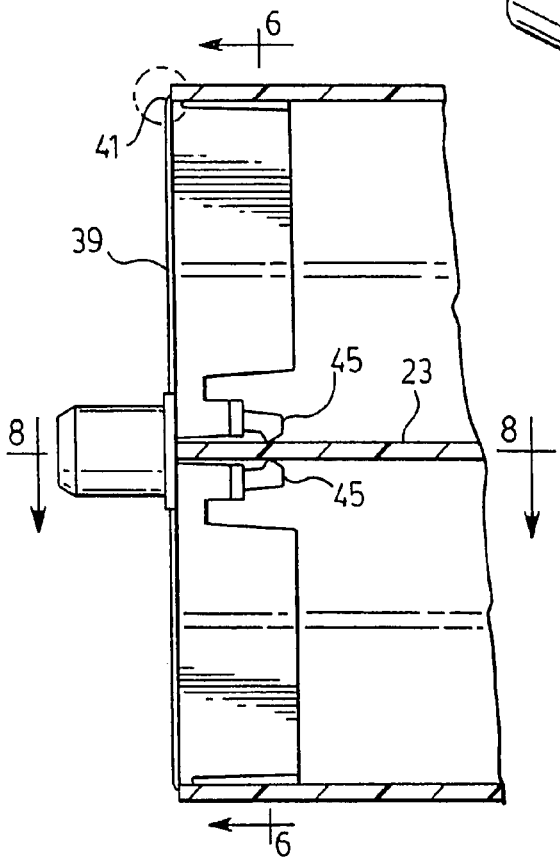
FIG. 5 is a sectional view of the end cap fitted with the louver body of FIG. 4.

In looking at FIGS. 5 and 9 of the drawings two features of the present invention will become apparent. Firstly, the face part 39 of the end cap is essentially flush with the end of the louver body i.e., face part 39 does not noticeably protrude beyond the mouthwall 27 of the louver body. This gives the louver a flat ended appearance the same as that found in a wooden shutter.

The second feature noted above is that the edge region around the face part of the end cap i.e., flashing 41 does not extend very far onto the mouthwall. Furthermore, there is essentially no visible gap between the flashing and the mouthwall particularly when seen from either the front or back surfaces of the louver. This also adds to the desirable flattened end appearance of the louver.

FIG. 10 of the drawings show how the mounting post 50 fits to the shutter frame 3. The frame itself provided with a plurality of pre located circular holes in each of the frame jambs to each side of the frame. The louvers are located in position before the frame jambs are finally assembled with one another by means of the connecting crossbeams of the frame. The posts 47 simply pivotally locate within the holes in the frame jambs.

The provision of the slots 51 in posts 47 ensures a snug fit of the louver posts with the frame jambs. This is due to the fact that the free end of each post has an unstressed diameter at least as great as that of the hole into which it is to be fitted. The post is collapsed at slot 51 which in combination with the tapered end 50 on the post enables the post to be squeezed into the opening. This eliminates sloppy play between the louver and the frame.

When the shutter is fully assembled the width across the interior dimension of the frame corresponds to the length of each louver measured between thickened face regions 49 to each end of the louver. Again, this helps to eliminate sloppiness between the louvers and the frame. It also ensures a good light block between the ends of the louver and the frame. However, there is still a very slight standoff between the louver end and the frame other than at the thickened face region 49. This standoff substantially reduces friction between the louver ends and the frame as the louvers are adjusted i.e., the only area of the louver end directly in contact with the frame is the relatively small surface area at the thickened region 49 of the end cap.

Figure 11:
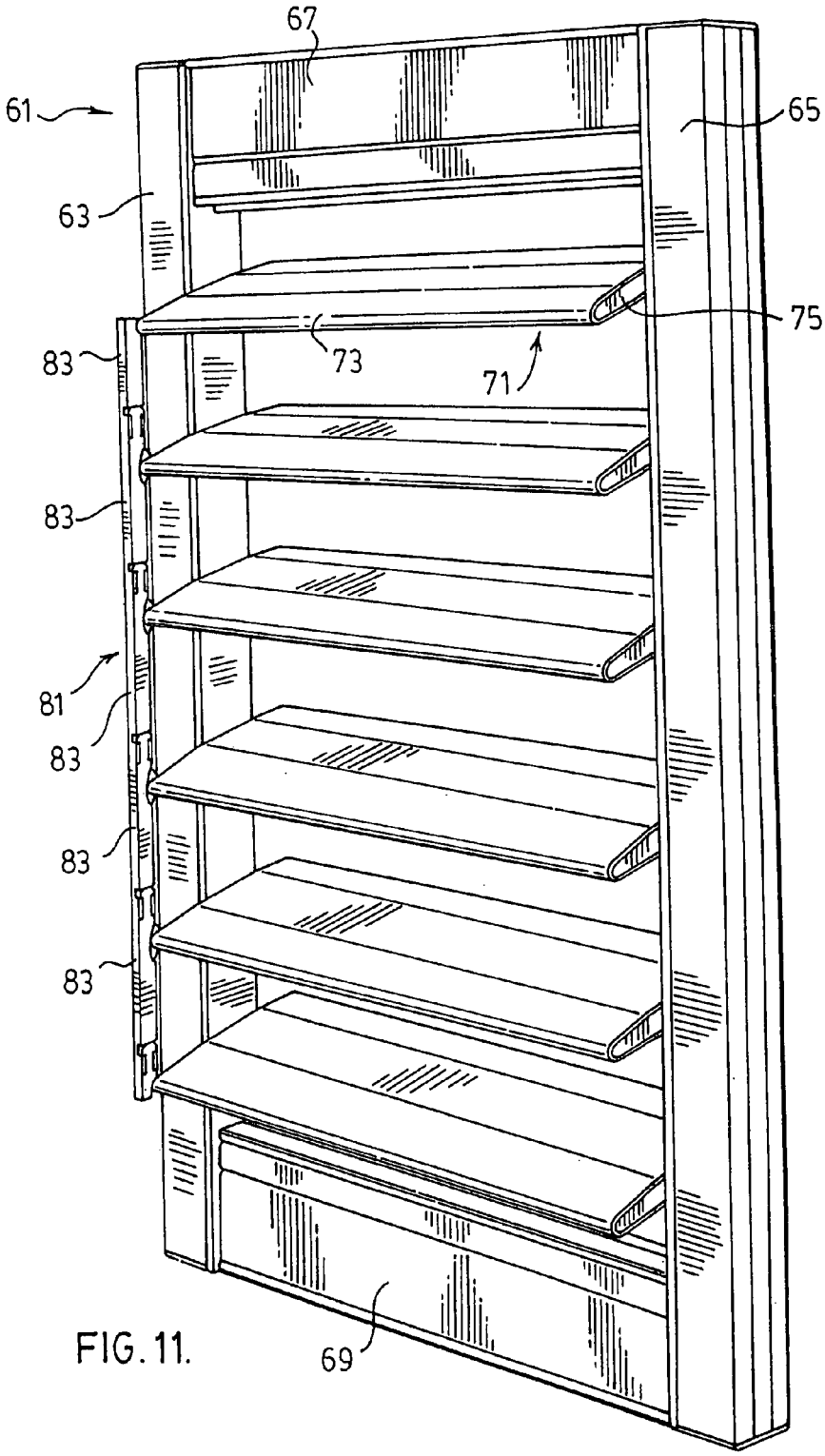
FIG. 11 is a perspective view of a shutter assembly having louvers fitted with end caps according to a further preferred embodiment of the present invention.
Figure 12:
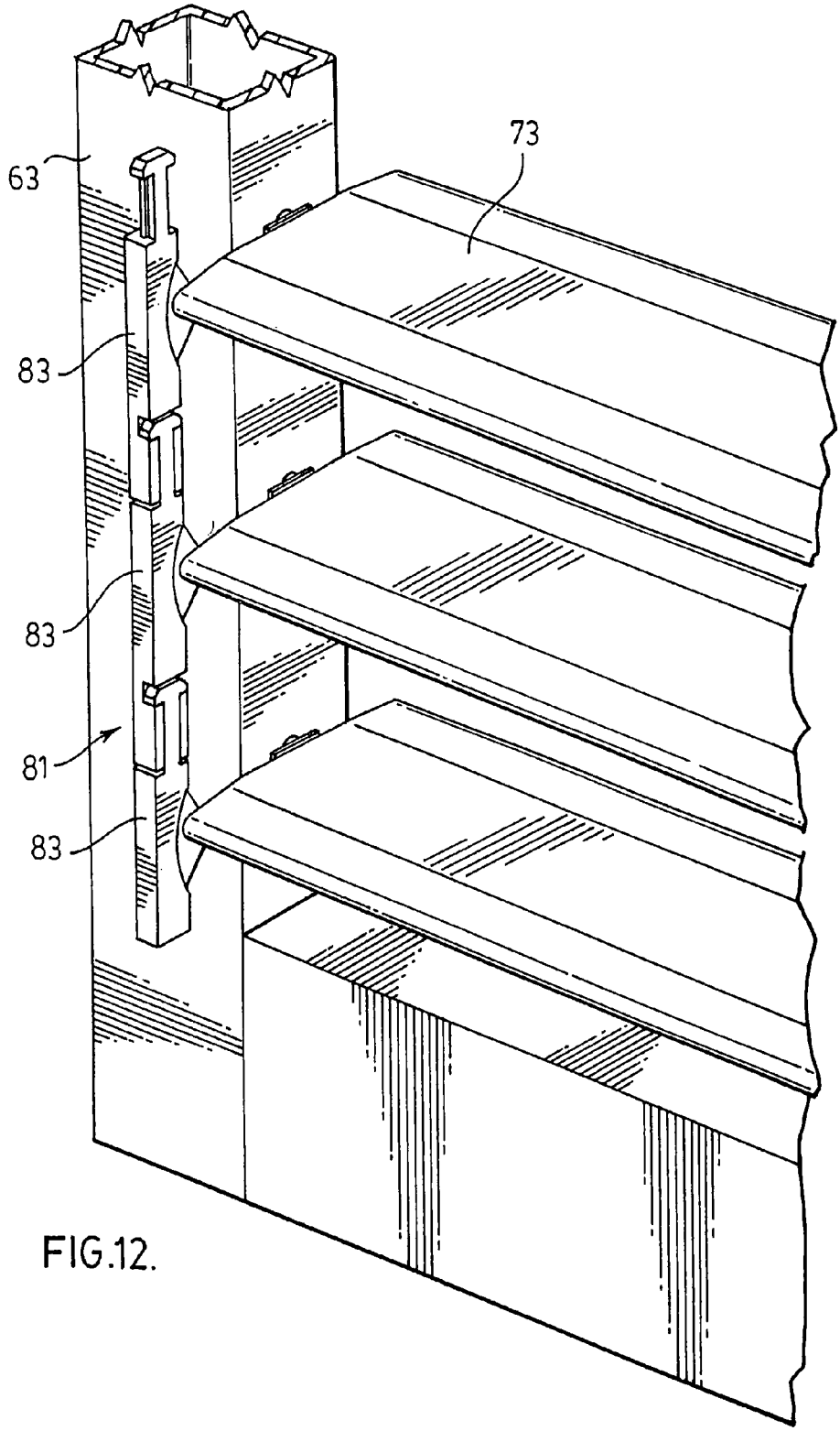
FIG. 12 is an enlarged view of the louvers fitted with end caps and also fitted to a control bar of the shutter of FIG. 11.

FIG. 11 of the drawings shows a further preferred plastic shutter generally indicated at 61. This shutter has a frame formed by a pair of vertical jambs 63 and 65 secured to one another by top and bottom crossbeams 67 and 69. A plurality of movable louvers generally indicated at 71 are pivotally trapped between the two vertical jambs of the shutter frame.

Figure 17:
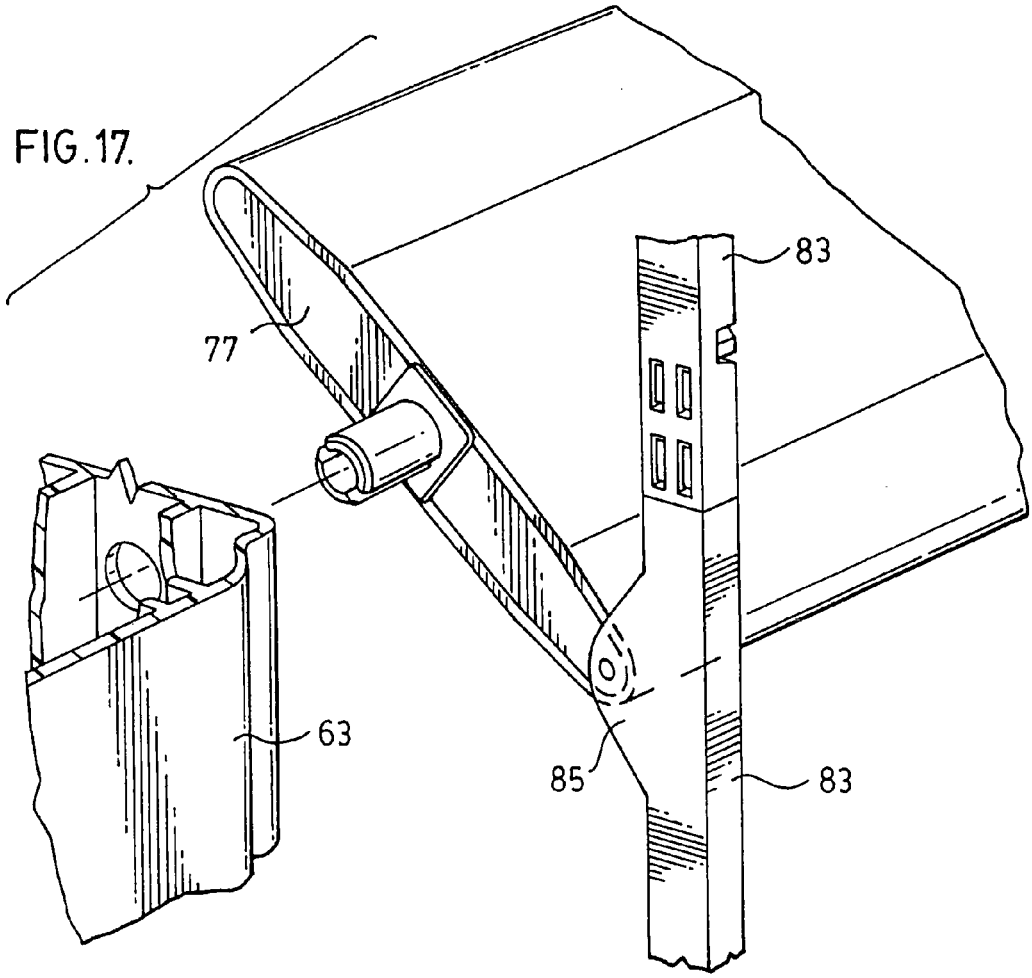
FIG. 17 is an exploded perspective view of the end of one of the louvers from the shutter of FIG. 11 connected to the control bar and ready for insertion into the frame of the shutter.

Each of the louvers 71 comprises a generally hollow louver body 73 having the same construction as the earlier described louver body 21. Each louver body 73 is fitted at one end with an end cap 75 which is shown in FIG. 11 of the drawings. The other end of the louver body is fitted with an end cap 77 shown in FIG. 17 of the drawings.

End caps 75 and 77 are very similar to one another and both of these end caps have all of the features described with respect to end cap 31. End cap 77 does however have one additional feature which is best seen in FIG. 13 of the drawings.

More specifically, end cap 77 includes a through bore 79 and at one end of the end cap. The purpose of the through bore is to receive a connecting post from a segment of a control bar generally indicated at 81 to one side of the shutter. This control bar links all of the louvers together with one another to enable a single adjustment for a simultaneous and uniform positioning of the louvers within the frame.

Figure 13:
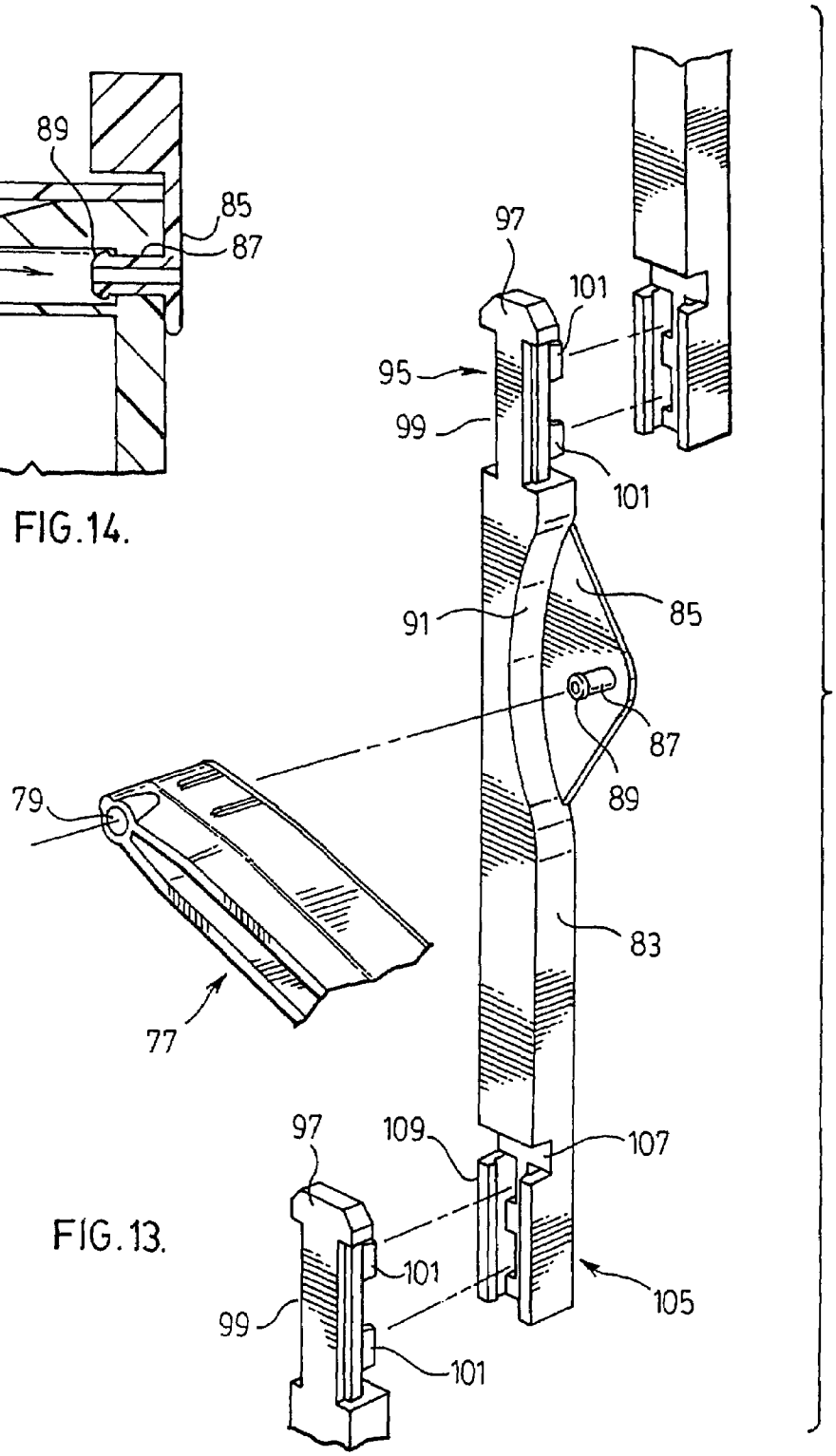
FIG. 13 is an exploded perspective view of the fitting of one of the end caps from one of the louvers of FIG. 12 to a segment of a control bar from the shutter of FIGS. 11 and 12.

As noted above, control bar 81 is formed by a plurality of bar segments all of which are identical and one of which is indicated at 83 of FIG. 13 of the drawings. This bar segment includes a relatively thin platform 85 extending from one side of the bar segment. Provided on platform 85 is a post 87 with a small head 89. Note that the bar segment 83 has a curved recessing 91 along its side edge at the platform 85.

Figure 14:
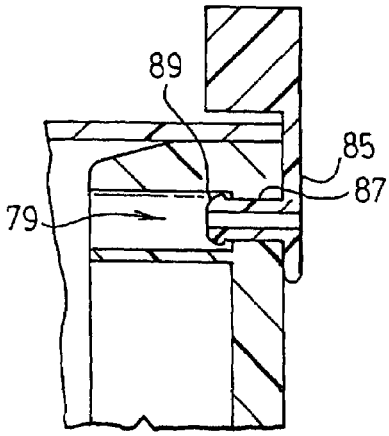
FIG. 14 is a sectional view showing the connection between the control bar segment to the louver end cap of FIG. 13.

The control bar is built such that the number of bar segments 83 is the same as the number of louvers used in the shutter. In other words, each louver has its own control bar segment. The post 87 on platform 85 pushes into the through bore 79 of the end cap to provide the connection between the control bar and the louver. The head 89 on the post 87 snap locks into position within through bore 79 which has a stepped configuration as shown in FIG. 14 of the drawings.

This ensures a positive interlock between the bar segment and the end cap of the louver.

As earlier noted, each bar segment has a curved side edge recess 91. This allows relative movement between the tip of louver and the control bar as occurs during adjustment of the louvers through the control bar.

The assembly of the control bar 81 made up of the bar segments 83 is a further unique feature to the present invention. Each of the bar segments 83 is identical to every other bar segment. Each bar segment includes a first connection region 95 to one end of the bar segment and a second connection region 105 to the other end of the bar segment. The connection region 95 of one bar segment interlocks with the connection region 105 of an adjacent bar segment.

Connection region 95 comprises a somewhat T-shaped member having a head 97 and side regions 99. Each of the side regions 99 has a stepped or tiered construction. Provided on the side face of the bar segment at connection region 95 are four protruding teeth 101.

Connection region 105 comprises a slot 107 in the bar segment. Located to one side of slot 107 are a pair of stepped arms 109. Openings 111 are also provided in connection region 105.

The bar is formed by snap connecting the bar segments together with one another. In order to do this the connection region 95 of one of the bar segments is snapped locked with the connection region 105 of the adjacent bar segment. This is done by pushing the stepped arms 109 of connection region 105 onto the stepped side surfaces 99 of connection region 95. The plastic construction of each bar segment allows for the flexing of the stepped arms onto the stepped side surfaces. The stepped shaping of the two ensures they interlock with one another. The length of the two interlocked connection regions assures that the bar segment remain longitudinally aligned with one another.

Figure 18:
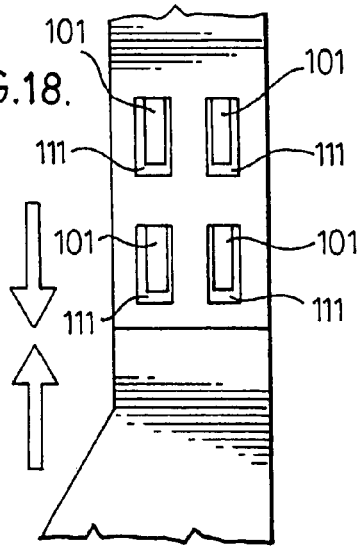
FIGS. 18 and 19 are enlarged side views of the connection region between bar segments of the control bar of the shutter of FIG. 11.

When the two connection regions are fitted with one another the head 97 of connection region 95 locates within the slot 107 of connection region 105. At the same time the teeth 101 of connection region 105 locate in the openings 111 of connection region 105. This is well shown in FIGS. 18 and 19 of the drawings.

A very desirable feature found in the assembly of the control bar is that it is length adjustable at each of the bar segments to ensure that each bar segment properly aligns with its associated louver. The length adjustable feature of the control bar is provided at the inter-fitting of the connection regions 95 and 105. Specifically, the slot 107 of connection region 105 is taller than the head 97 of the connection region 95. The arms 109 of connection region 105 are shorter than the recessed side regions 99 of connection 95. The teeth 101 of connection region 95 are shorter than the openings 111 in connection region 105.

As a result of the difference in dimensions of the various parts described immediately above, the two connection regions are allowed to slide vertically relative to one another while the adjacent bar segments remain connected. There is however sufficient frictional engagement between the two connection regions to prevent any unnecessary sliding between connected bar segments. The sliding between bar segments will therefore only occur as necessary to maintain appropriate spacing between the connected tips of adjacent louvers.

Figure 19:
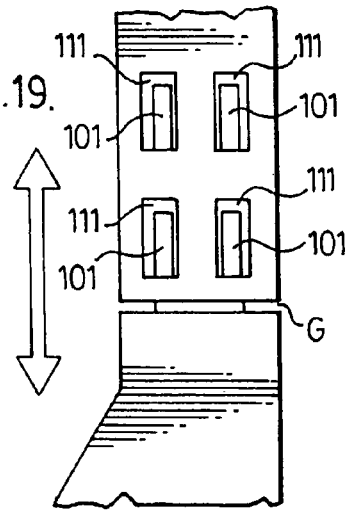
Figure 20:
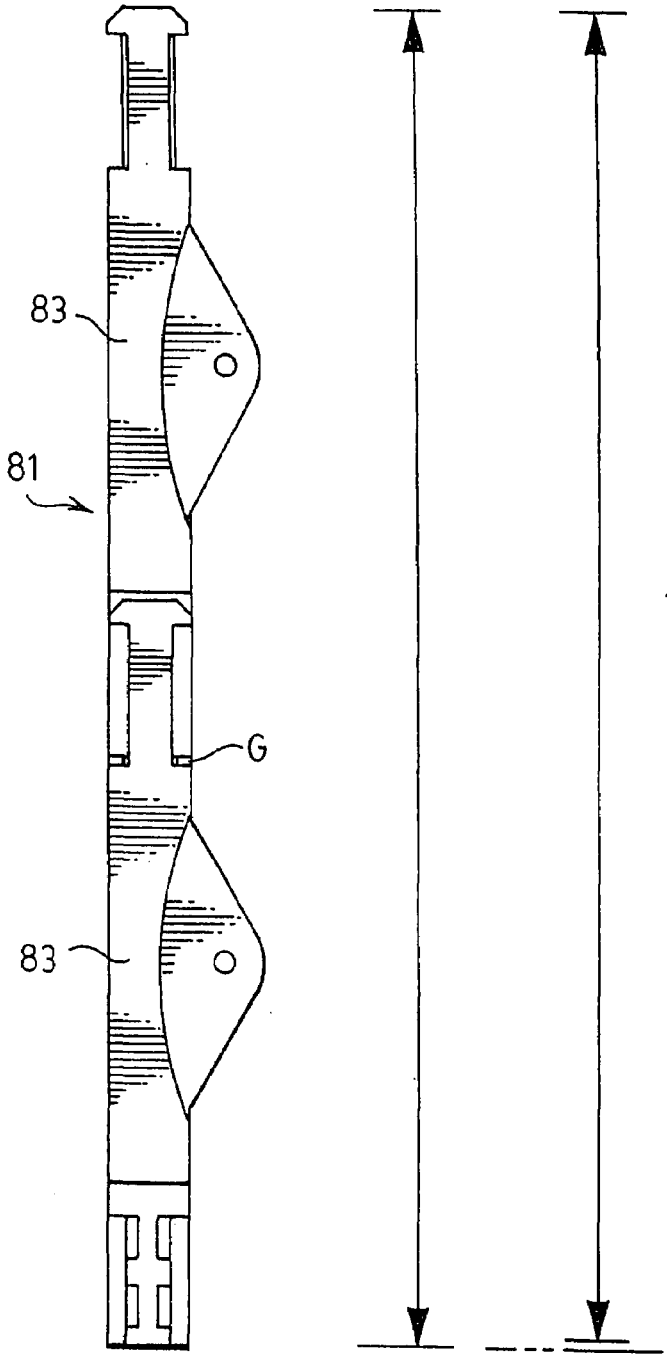
FIGS. 20 and 21 show length adjustable connections between bar segments of the control bar from the shutter of FIG. 11.
Figure 21:
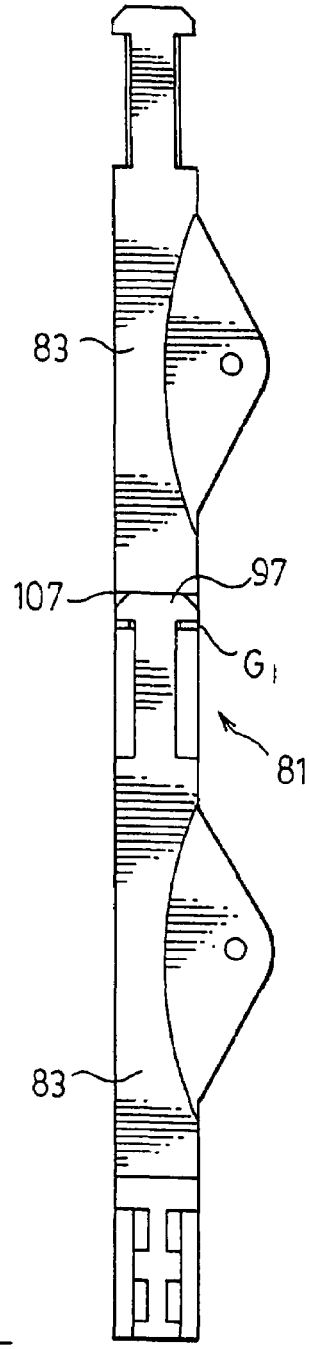

FIGS. 18 through 21 well demonstrate automatic length adjustability of control bar 81. In particular, in FIG. 18 it will be seen that the two connected bar segments 83 are set such that there is no gap at the lower edge of the two connection regions. In this position, the teeth 101 of connection region 95 are located at their upper most positions in the openings 111 in connection region 105. The same positioning is shown in FIG. 21 of the drawings in which the head 97 of the lower connection region 95 is pushed up as far as possible within the slot 107 of the upper connection region. This leaves a slight gap G1 beneath the head 97 in the slot 107.

The above positioning is to be compared to the positioning shown in FIGS. 19 and 20 of the drawings. Here it will be seen that the two connection regions are vertically separated from one another as much as possible. The teeth 101 of the connection region 95 sit as low as possible in the openings 111 of connection region 105. At the time the head 97 of connection region 95 is pulled down as far as possible in the slot 107 of connection region 105. This leaves a gap G between the two connection regions.

In comparing FIGS. 19 and 20 it will be seen that the two connected bar segments of FIG. 20 are longer than the two connected bar segments of FIG. 21. There is not a substantial difference in length however this difference is sufficient to accommodate for typical tolerances which may occur in the building of the overall shutter assembly.

A further feature of the present invention is seen having reference to FIGS. 15 and 16 of the drawings.

FIGS. 15 and 16 show a further preferred feature of the present invention. This feature relates to the light block capacity of the shutter even when fitted with the control bar.

More specifically, even though the end caps 77 of each of the louvers is pushed slightly away from frame jamb 63 due to the provision of the control bar i.e., by the width of platform 85 essentially no light is allowed to pass through the shutter in this area. This is because when the louvers are in their closed light blocking positions as seen in FIGS. 15 and 16 the control bar moves itself to a light blocking position. The control bar with the louvers in their closed positions seats against the frame jamb 63 and therefore prevents light from passing through the shutter between the louvers and frame jamb 63.

As a further preferred feature of the present invention it will be noted that when the louvers are closed the control bar is essentially hidden along the inside edge of frame jamb 63. In this regard the control bar not only nests against the inside surface of the frame jamb but in addition sits recessed from the outside or front surface of the frame jamb. This gives the overall shutter an extremely neat and clean appearance.

Although various preferred embodiments of the present invention have been described in detail, it will be appreciated by those skilled in the art that variations may be made without departing from the spirit of the invention or the scope of the appended claims.

The embodiments of the invention in which an exclusive property or privilege is claimed are defined as follows:

1. A plastic louver to be swingably mounted in a shutter frame, said plastic louver comprising a generally hollow louver body having a mouth at each end of the louver body, said mouth being surrounded by a mouthwall, and an end cap fitted to each end of the louver body, each end cap comprising an insert part which slides into the mouth and a face part which is exposed at the end of the louver body, each cap including a cylindrical frame mount post centrally of said face part, said post being supported by a thickened face region of the face part of the end cap; and wherein said post is slotted lengthwise thereof.

2. A plastic louver as claimed in claim 1, wherein the face part includes a surrounding flashing which locates against without completely covering the mouthwall around the mouth, the flashing being of a size to provide sufficient strength from pushing into the mouth of the louver body with the end cap essentially flush with an end of said louver body.

3. A plastic louver as claimed in claim 2 wherein said flashing has a tapered shape which narrows outwardly of the flashing.

4. A plastic louver as claimed in claim 2 wherein said flashing has a minimum outward extension past the insert part of about 5 thousandths of an inch.

5. A plastic louver as claimed in claim 4 wherein said flashing is between about 5 thousandths and 25 thousandths of an inch.

6. A plastic louver as claimed in claim 1 wherein said insert part of said end cap includes louver body grip bars protruding therefrom towards opposite ends and to opposite sides of the insert part.

7. A plastic louver as claimed in claim 6 wherein said insert post of said end cap has a cut out region beneath said thickened face region of said face part, said louver body including a central stiffening rib internally thereof, said end cap including a pair of spaced apart rib grip arms, said grip bars when pushed into the mouth at the louver end causing the cut out region to collapse and forcing the grip arms to push onto and lockingly engage with the stiffening rib of the louver body.

8. A plastic louver as claimed in claim 1 wherein said end cap includes a control bar receiving opening through the face part at an end region of the end cap.

9. A plastic louver as claimed in claim 8 wherein the control bar receiving opening is fitted with a post of a segment of a control bar.

* * * * *